United States Patent [19]

Wissmann et al.

[11] Patent Number: 4,773,362

[45] **Date of Patent: * Sep. 27, 1988**

[54] AUTOMATIC STARTING ARRANGEMENT FOR AN INTERNAL COMBUSTION ENGINE

[75] Inventors: Michael Wissmann, Schorndorf-Weiler; Hans Nickel, Cottenweiler; Jürgen Weber, Waiblingen, all of Fed. Rep. of Germany

[73] Assignee: Andreas Stihl, Waiblingen, Fed. Rep. of Germany

[ * ] Notice: The portion of the term of this patent subsequent to Jun. 16, 2004 has been disclaimed.

[21] Appl. No.: 62,121

[22] Filed: Jun. 15, 1987

Related U.S. Application Data

[63] Continuation-in-part of Ser. No. 809,013, Dec. 13, 1985, Pat. No. 4,672,929.

[30] Foreign Application Priority Data

Dec. 15, 1984 [DE] Fed. Rep. of Germany ..... 3445839

[51] Int. Cl.[4] ..... F02M 1/10

[52] U.S. Cl. ..... 123/179 G; 123/179 A; 123/180 T; 123/398; 261/52; 261/64.4

[58] Field of Search ..... 123/179 A, 179 G, 180 T, 123/398; 261/64.6, 52, 64.4

[56] References Cited

U.S. PATENT DOCUMENTS

| | | | |
|---|---|---|---|
| 1,957,289 | 5/1934 | Purpura | 123/179 A |
| 2,030,331 | 2/1936 | Smith | 123/179 A |
| 2,158,572 | 5/1939 | Curtis | 123/179 A |
| 2,762,354 | 9/1956 | Winkler | 123/179 A |
| 3,237,527 | 3/1966 | Martin | 261/52 |
| 3,484,084 | 12/1969 | Simpson et al. | 261/52 |
| 3,831,567 | 8/1974 | Freismuth et al. | 261/64.6 |
| 4,406,066 | 9/1983 | Itzrodt | 123/179 G |
| 4,439,377 | 3/1984 | Nartowski | 261/64.4 |
| 4,672,929 | 6/1987 | Wissmann et al. | 123/179 A |

*Primary Examiner*—Andrew M. Dolinar
*Attorney, Agent, or Firm*—Walter Ottesen

[57] ABSTRACT

An automatic starting arrangement for a hand-started internal combustion engine is disclosed. Internal combustion engines of this type have a choke flap and a throttle flap positioned one behind the other in the air-intake channel. In order to ensure a reliable starting of the engine independently of manual positioning activities, the invention provides that in the starting operation, the choke flap initially moves independently of the throttle flap. The throttle flap is held in a half-throttle position between the full-throttle position and the idle position. Before the choke flap is brought into its at-rest no-choke position, a movable holding mechanism is actuated and the throttle flap is released.

16 Claims, 8 Drawing Sheets

FIG. 3
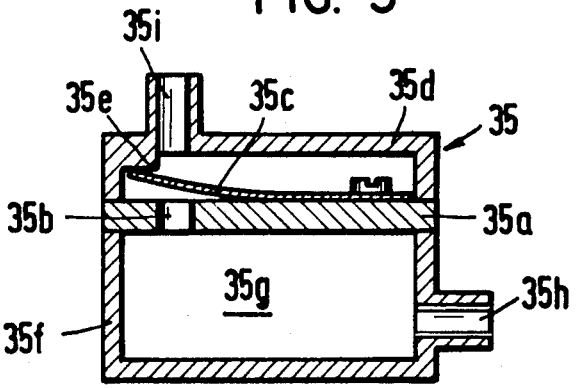
FIG. 4
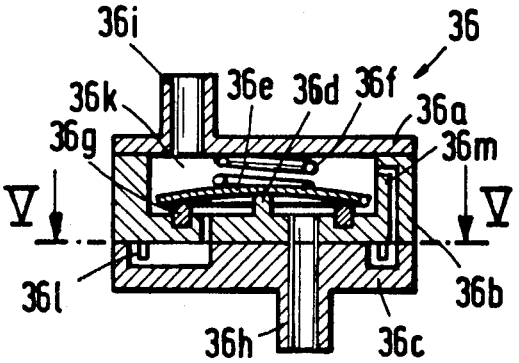
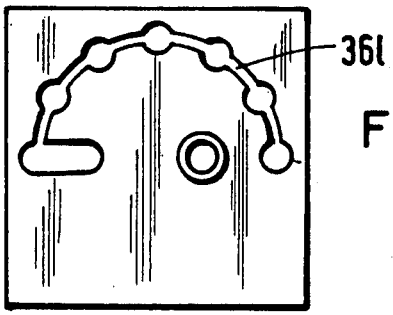
FIG. 5

AUTOMATIC STARTING ARRANGEMENT FOR AN INTERNAL COMBUSTION ENGINE

RELATED APPLICATION

This is a continuation-in-part of application Ser. No. 809,013, filed Dec. 13, 1985 and entitled "Automatic Starting Arrangement for an Internal Combustion Engine" which has now issued as U.S. Pat. No. 4,672,929.

FIELD OF THE INVENTION

The invention relates to an automatic starting arrangement for an internal combustion engine such as the manually startable engine of a chain saw.

BACKGROUND OF THE INVENTION

With manually startable internal combustion engines, the operating person has to adjust the hand-choke as part of the starting procedure in order to get the necessary overrich mixture for the starting phase. After the motor has started, the choke has to be pulled out at the right point in time which can be problematic for the inexperienced user and often leads to the mixture becoming lean too quickly resulting in a standstill of the engine. Under unfavorable starting conditions, even for the experienced user, the starting of a two-cycle internal combustion engine by means of a rope-starter and hand-choke can be very problematic and can lead to difficult start attempts.

SUMMARY OF THE INVENTION

It is an object of the invention to provide a starting arrangement for an internal combustion engine which makes it possible for the inexperienced user to start the engine simply and with certainty even under unfavorable starting conditions.

An optimal starting position of the choke flap and throttle flap is preset independently of external adjustment by means of the position-dependent coupling of the choke flap with the throttle flap. The choke flap is immediately taken out as soon as the engine starts via the actuating device which is activated in dependence upon the operational condition of the engine. In its at-rest position, the choke flap is decoupled from the throttle flap so that the latter can be adjusted independently of the position of the choke flap via the known throttle lever and throttle linkage in order to accelerate or decelerate the engine.

The throttle flap is operatively connected in the opening direction with the choke flap via a coupling linkage so that, if the actuating device does not operate, the choke flap can be opened by means of the throttle linkage.

Preferably, the actuating device is an underpressure device actuable by the underpressure in the crankcase of the engine and is in the form of a bellows. The bellows is connected with the crankcase via a check valve so that only underpressure can act on the bellows. The check valve has preferably a membrane disposed between an opening closeable by the membrane and the crankcase and is pretensioned in the direction toward the crankcase in the opening direction. This affords the advantage that the entire system is quickly ventilated again when the engine is at standstill; that is, the choke flap immediately closes again when the engine does not run up during the starting procedure because of lack of fuel and remains stationary with the bellows however being actuated.

A reservoir is preferably provided in the conduit to the bellows downstream of the check valve in order to compensate for leakage quantities of overpressure which get into the conduit system before the membrane is closed.

According to the further feature of the invention, a thermostat valve is interposed between the check valve and the bellows which changes the flow cross section of the connecting conduit. This thermostat is preferably fixedly mounted between the cooling ribs on the cylinder head of the engine. As soon as the engine becomes warm, the thermostat valve clears a relatively large through-flow cross section so that the choke flap which is no longer needed is opened more quickly during the starting of a warm engine.

In order to ensure that the throttle flap does not return too quickly to the idle position when the choke flap is opened quickly, the suction cross section to the bellows is reduced after an initial stroke movement. In this way, by means of a fast initial stroke movement, the choke flap is brought into a position wherein it no longer has any substantial influence and, however, the throttle flap cannot yet travel back to the idle position. The choke flap reaches its at-rest position only then after the slower end stroke movement of the bellows is completed while the throttle flap can also move back into its idle position.

BRIEF DESCRIPTION OF THE DRAWING

The invention will now be described with reference to the drawing wherein:

FIG. 3 is an elevation view, in section, of the check valve of the automatic starting arrangement;

FIG. 4 is an elevation view, in section, of the thermostat valve of the automatic starting arrangement;

FIG. 5 is a plan view taken along line V—V of FIG. 4;

DESCRIPTION OF THE PREFERRED EMBODIMENTS OF THE INVENTION

Figure 1:
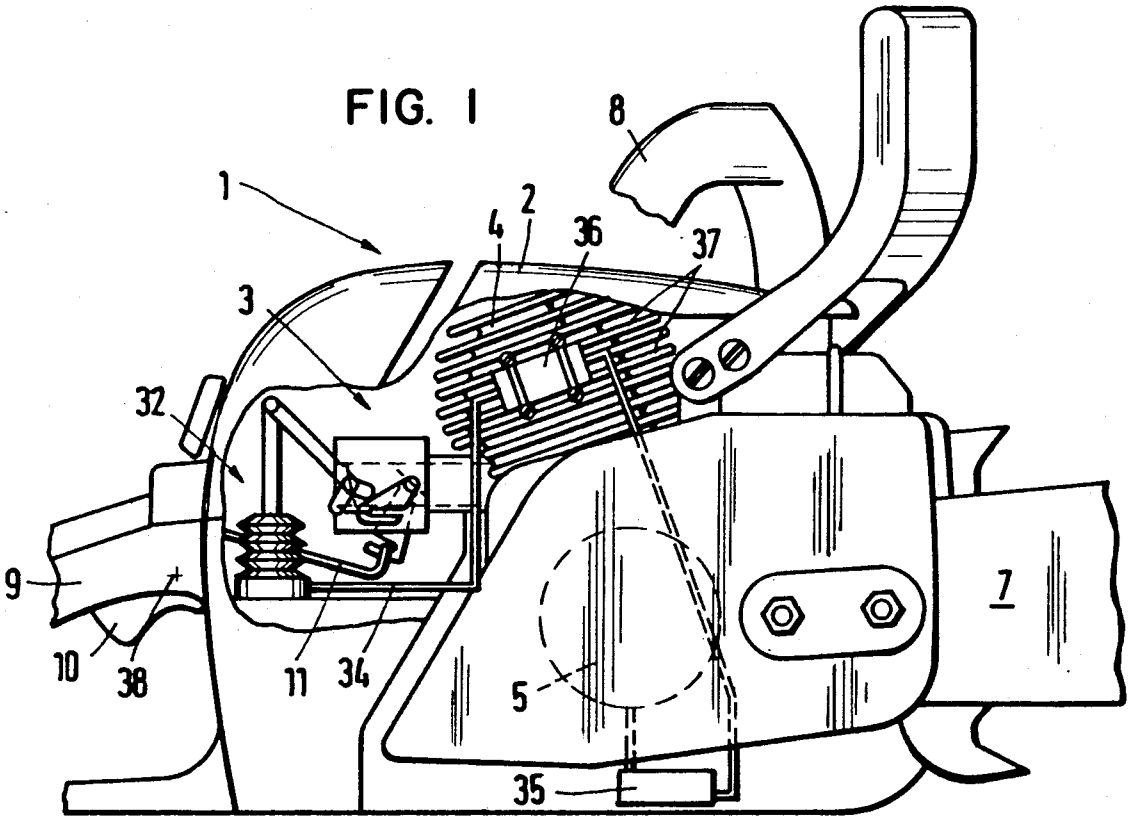
FIG. 1 is a detail of a motor-driven chain saw wherein a portion of the housing is broken away to show the automatic starting arrangement of the invention.

FIG. 1 shows a motor-driven chain saw 1 having a housing 2 wherein a two-cycle internal combustion engine equipped with a carburetor 3 is mounted. The engine comprises essentially a cylinder 4 with a piston which drives a crankshaft journalled in a crankcase 5. The crankshaft drives a saw chain (not shown) on a guide bar 7 via a pinion.

The motor-driven chain saw 1 has the usual and well-known configuration and is started by means of a rope starter in a manner known per se. The chain saw includes two handles 8 and 9 with a throttle lever 10 being mounted in the handle 9. The throttle lever 10 acts upon the throttle flap 12 in the air-intake channel 13 of the carburetor 3 via a throttle linkage 11 and displaces the flap 12 against the force of a torsion spring.

Figure 2:
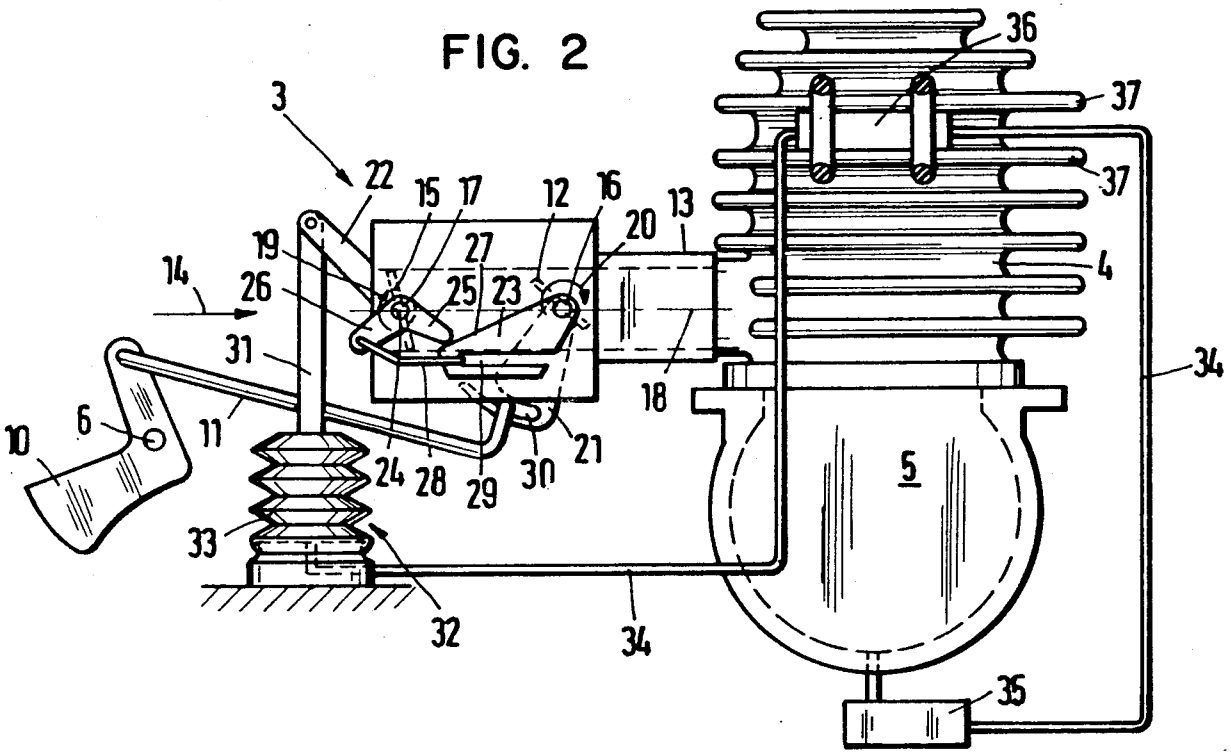
FIG. 2 is a detail schematic showing the configuration of the starting arrangement according to the invention.

The automatic starting arrangement according to the invention is built into the housing 2 of the chain saw 1 and is illustrated schematically in FIG. 2. The air-intake channel 13 of the carburetor 3 opens into cylinder 4. A choke flap 15 and a throttle flap 12 are arranged in the air-intake channel 13 one behind the other viewed in the direction of flow 14. Both flaps 12 and 15 are fixedly connected with shafts 16 and 17, respectively, for rotation therewith. As seen in FIG. 2, the shafts 16 and 17 lie at an elevation in the air-intake channel corresponding to approximately the central longitudinal axis of the latter. Positioning and actuating levers are fixedly mounted at the free ends of shafts 16 and 17 for rotation therewith. The levers are arranged so as to be perpendicular to the shafts and are substantially configured as flat members. The levers fixedly attach to the two shaft ends and the shafts corresponding thereto define respective rigid rotatable units together with the corresponding ones of the flaps.

The choke flap 15 is resiliently biased into its closed position in the direction of arrow 19 by means of a schematically illustrated torsion spring whereas the throttle flap 12 is resiliently biased in the direction to the idle position by means of a torsion spring in the direction of arrow 20.

The respective levers 24 and 23 of choke flap 15 and throttle flap 12 mounted on one side of the carburetor 3 are disposed with respect to each other such that in the closed position of the choke flap 15 shown, the throttle flap 12 is held open at approximately 30° in the half-throttle position. For this purpose, the flaps 12 and 15 are position-dependently coupled with each other.

The lever of the choke flap 15 is configured as a bell crank lever 24. When the choke flap 15 is closed, the free end of leg 25 lies against the facing edge 27 of lever 23 of the throttle flap 12 whereby the 30° position of the throttle flap 12 is preset.

A coupling rod 28 is pivotally connected to the free end of the other leg 26 of the lever 24 and engages an elongated slot 29 in lever 23 of the throttle flap 12. In the 30° position of the throttle flap 12, the elongated slot 29 lies approximately parallel to the center longitudinal axis 18 of the air intake channel 13 and is preferably open at its end facing toward cylinder 4. In the 30° position of the throttle flap 12 and closed choke flap 15, the coupling rod 28 lies against the other closed end of the elongated slot 29 so that a stable position of both flaps to one another is given notwithstanding the respective leg springs acting in the directions 19 and 20. The coupling rod 28 is configured so that it holds the choke flap 15 in the open position at least in the full throttle position and, as part of the emergency start device to be described below, the coupling rod 28 makes a displacement of the choke flap 15 possible by an actuation of the throttle flap 12. The coupling rod 28 with the appropriate configuration assures that the choke flap 15 is held in an open position in the event of a loss of the underpressure associated with extreme conditions. These extreme conditions include full throttle, lower rotational speed, increased friction or increased positioning forces as a consequence of dirt.

By changing the dimensions of the coupling rod 28 and especially of the leg 25 of the lever 24, also other opening positions of the throttle flap 12 between idle position and full-throttle position are given with choke flap 15 closed.

The positioning levers 21 and 22, which are disposed on the other side of the carburetor 3 and fixedly attached to shafts 16 and 17 for rotation therewith, are each connected with an actuating device. The throttle flap 12 is connected with a throttle lever 10 via a throttle linkage 11. The throttle lever 10 is configured substantially as a bell crank lever pivotable about shaft pin 6. The one leg of the throttle lever permits actuation by an operating person; whereas, the throttle linkage 11 is pivotally connected at the free end of the other leg. The throttle linkage engages with its other free end into an elongated slot 30 of the positioning lever 21. The elongated slot 30 preferably opens toward the gas lever 10 and the positioning lever 21 passes over a circular arc about the axis of the shaft 16. By actuating the throttle lever 10, the throttle linkage 11 travels on the closed end of the elongated slot and displaces the throttle flap 12 against the force of the torsion spring acting in the direction 20. In the full-throttle position, the throttle flap 12 is approximately on the center longitudinal axis 18 of the air-intake channel 13.

The positioning lever 22 of the choke flap 15 is connected with the positioning rod 31 of an actuating device 32 which is actuable in dependence upon the operational condition of the engine.

In the embodiment shown, the actuating device 32 includes a bellows 33 which is connected via conduit 34 and check valve 35 with the crankcase 5 of the engine. In this way, the bellows 33 is charged with the underpressure present in the crankcase 5 during operation of the engine. With a sufficiently high underpressure in the bellows 33, the positioning rod 31 travels back and pivots the choke flap 15 via the positioning lever 22 into an at-rest position wherein the choke flap lies approximately on the central longitudinal axis 18 of the air intake channel 13 and clears the full pass-through cross section of the latter.

In the standstill condition of the engine, the choke flap 15, which is integrated into the carburetor 13, is closed because of the torsion spring on the shaft 17 and acting in a direction 19. Simultaneously in this position, the throttle flap 12 is held open in its half-throttle position of approximately 30° by levers 23 and 24 against the force of its torsion spring acting in the direction 20. When the engine is thrown on and during run-up thereof, the underpressure obtained via the check valve 35 from the crankcase 5 charges the bellows 33 via conduit 34 in response to which the bellows pulls on the positioning rod 31. In this way, the choke flap 15 is transferred into its open position via positioning lever 22 insofar as the motor continues to run up. Because of the displacement movement of the choke flap 15, the throttle flap 12 is slowly released so that the latter is displaced into the idle position in the direction 20 by means of the torsion spring associated therewith. However, the throttle flap 12 reaches the idle position, in time, after the complete opening of the choke flap so that shortly after the start, an increased idle is provided and the engine can burn itself free of the overrich mixture.

In order to obtain an opening of the choke flap 15 which is dependent on the ambient temperature and on the temperature of the engine, a thermostat valve 36 is provided and is connected in the conduit 34 between the check valve 35 and the bellows 33. The thermostat valve 36 is mounted on the cylinder head 4 and is preferably attached between the cooling ribs 37 thereof. The thermostat valve 36 changes the flow-through cross section of the conduit 34 in dependence upon the temperature.

The thermostat valve 36 is shown in FIGS. 4 and 5 and essentially comprises three parts 36*a* to 36*c*. A bimetal 36*e* is centrally mounted on a centric lug 36*d* in the cup-shaped intermediate piece 36*b*. The bimetal 36*e* is braced on the cover 36*a* of the thermostat valve 36 via a spring 36*f*. A sealing ring 36*g* is mounted coaxially around the centric lug 36*d* on which the rounded cap-shaped bimetal 36*e* lies in seal-tight engagement when beneath its switching temperature. The conduit 34 coming from check valve 35 opens inside the sealing ring 36*g* via the connecting stub 36*h* whereas, the conduit section leading to the bellows 33 is connected at connecting stub 36*i* which opens into the cup-shaped space 36*k* of the intermediate piece 36*b*. A series connection of throttles 361 of large cross section is mounted in the base 36*c*. The throttles 36*l* connect the chamber within the sealing ring 36*g* with the cup-shaped chamber 36*k* which is, in turn, connected via connecting stub 36*i* with the bellows 33. For this purpose, a bypass 36*m* is provided in the wall of cup-shaped intermediate piece 36*b*.

Beneath the switching temperature, the bimetal 36*e* lies tightly against the sealing ring 36*g* so that a very intense throttling via the series connection of throttles 36*l* and bypass 36*m* is provided for a sufficiently slow draw-in speed of the bellows 33. By means of the series connection of several throttles 36*l* having a large cross section, effectively the same throttle value is obtained as for a throttle with a small pass-through cross section; however, the danger of blockage of such a series connection of throttles is substantially less.

As soon as the switching temperature is reached, the bimetal snaps back away from the sealing ring 36*g* and clears the direct connection of the connecting stub 36*h* with the connecting stub 36*i* wherein no throttle path is provided thereby assuring that, with the start procedure of a warm engine, the choke flap 15 is rapidly opened in order to prevent a too intense overriching of the mixture.

Notwithstanding the rapid opening of the choke flap, an overenrichment nonetheless occurs at the beginning of the starting operation which must be compensated by a rev-up of the engine in the starting phase. For this purpose, the bellows 33 is configured as will now be explained.

Figure 6:
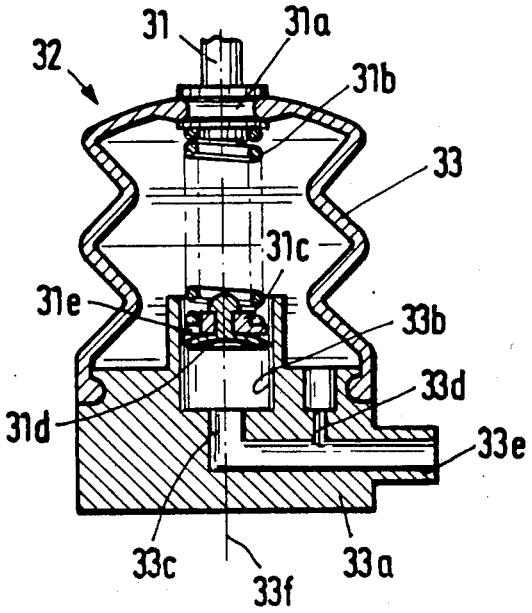
FIG. 6 is an elevation view, in section, of the bellows of the automatic starting arrangement of the invention.

Referring to FIG. 6, the lower end of the bellows 33 is tied down to the base 33*a;* whereas, the other end is buttoned to a one button part 31*a* of the positioning rod 31. The positioning rod 31 is extended into the interior of the bellows 33 as a spiral pressure spring 31*b* with the free end of the spiral spring 31*b* carrying a slider 31*c* which is guided in a cylindrical seat 33*b* in the base 33*a*. The suction opening 33*c* opens into the cylindrical seat and communicates with the inner chamber of the bellows 33 via a connecting opening 31*e* in the slider 31*c*. Further, a bypass 33*d* is provided which detours around the suction opening 33*c*. The bypass 33*d* has a lower pass-through cross section than the suction opening 33*c*. The spiral spring 31*b*, the cylindrical seat 33*b*, the slider 31*c* as well as a valve element 31*e* held in the slider are coaxial to the center longitudinal axis 33*f* of the bellows 33. The bellows 33 is connected via the connecting stub 33*e* with the conduit 34 coming from the thermostat valve 36.

If the engine is thrown on with a completely open cross section of the thermostat valve 36, air will be drawn relatively rapidly by suction from the bellows via the bypass 33*d* and the connecting opening 31*e* so that a rapid initial stroke movement of the positioning rod 31 is obtained.

In this opened position, which however does not yet correspond to the at-rest position, the throttle flap 12 is still held in a partial throttle position via levers 23 and 24 so that also with a rapid opening of the choke flap 15, the engine can rev up and burn itself free of the initial overenrichment.

The rapid starting stroke movement continues until the valve element 31*d* mounted to the slider 31*c* seals the suction opening 33*c* and only the suction cross section of the bypass 33*d* is still open. The positioning rod 31 is guided in the seat 33*b* via the stretched spiral spring 31*b* during the rapid initial stroke movement. After the valve element 31*d* lies seal-tight on the base of the seat 33*b*, the bellows 33 moves through the slower end portion of the stroke movement whereat the spiral spring 31*b* is pressed together. During the slower terminal portion of the stroke movement, the choke flap 15 is transferred into its at-rest position wherein the choke flap completely releases the throttle flap so that the latter can move over into the idle speed position because of its torsion spring. After an initial run-up, the rotational speed of the engine drops down to the idle speed.

Figure 7:
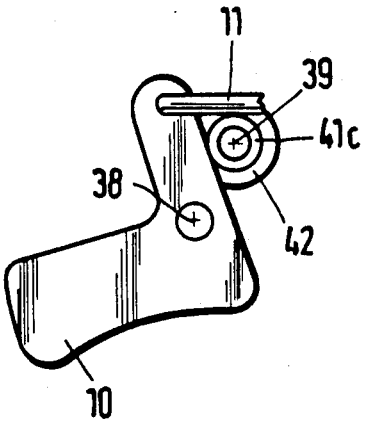
FIG. 7 is a side elevation view of an emergency start device on the throttle lever.
Figure 8:
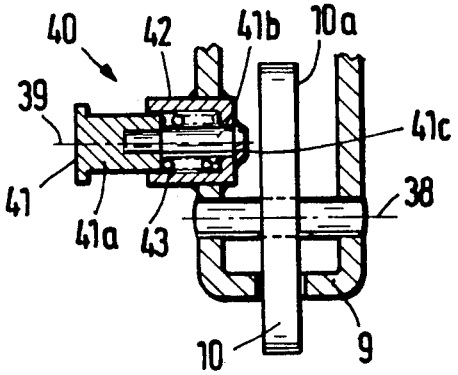
FIG. 8 is a front elevation view, partially in section, of the emergency start device of FIG. 7.

If the engine is operated too rich during the starting phase because of unfavorable operating conditions such that it no longer starts, it can be purposeful to provide an emergency start device 40 (FIGS. 7 and 8). The device 40 is made up of a detent 41 which can be brought into the pivot path of the throttle lever 10 and with which the throttle lever is latched into a given position. In this position, the throttle flap 12 is opened via the throttle linkage 11 and the choke flap 15 is brought into its open position via the coupling rod 28.

As shown in FIG. 8, the detent 41 has a first cylindrical portion 41*a* which is axially guided in a bushing 42. The bushing 42 is attached in the handle housing 9 and is preferably welded in place. The free end of portion 41*a* is configured as a push button and has a collar which has a diameter greater than the inner diameter of the bushing 42. On the other end lying in the bushing 42, a second portion 41*b* extends from the detent 41 and is configured so as to have a lesser diameter. The second portion 41*b* is tightly connected with the first portion 41*a* by means of an extension engaging axially into the first portion 41*a*.

The free end of the second portion 41*b* passes through the base of the bushing and has a collar 41*c* which has a diameter greater than the pass-through opening in the base. A spiral spring 43 is mounted in the bushing. The spring 43 braces itself with one of its ends on the base of the bushing 42 and with its other end on the free annular surface of the first portion 41*a* and so applies force to the detent 41 pushing it out of the bushing into an at-rest position.

To actuate the emergency start device 40, the throttle lever 10 is pivoted in the direction of full throttle about the axis 38 until the latch 41, parallel to pin 38, can be pushed into the pivot path of throttle lever 10 by pressing down against the force of spring 43. If the throttle lever is released, it comes to rest against the detent 41 in the direction toward the idle speed position whereby the given position for the start is set. The axis 39 of the detent 41 is such that, in the latched position, the throttle flap 12 as well as the choke flap 15 are held in the open position by means of the throttle lever 10.

Preferably, the emergency start device 40 is so configured that the collar 41*c* of the detent 41 lies against the side 10*a* of the throttle lever facing away from the detent in the latching position. In this way, it is assured that the detent is held on the throttle lever in a form-tight manner and blocks the latter without the throttle lever becoming unlatched by blows and vibrations caused when starting.

After the motor has started, the detent becomes unlatched by again actuating the throttle lever 10. The detent jumps into its at-rest position because of the spring 43. By pivoting the throttle lever 10 in the idle position, the throttle flap 12 is transferred into the idle position while the choke flap 15 is held in its at-rest position by means of the actuating device 32.

In order to ensure a rapid ventilation of the bellows 33 at standstill of the motor, the check valve 35 is configured as a membrane valve. Referring to FIG. 3, the check valve has a base 35*a* with an opening 35*b* which is closeable by a membrane pretensioned in the direction of the opening. The membrane 35*c* is fastened to the base and is preferably a steel membrane. The steel membrane is covered by means of a cup-like upper housing part 35*d* which lies on the base 35*a* in a seal-tight manner. The stroke of the steel membrane 35*c* is limited by means of a stop 35*e* in the upper housing part 35*d*. The pretensioning of the steel membrane is given by its bending radius. The surface of the base 35*a* facing towards the steel membrane 35*c* has a flat finish to ensure a leak-free sealing.

A housing 35*f* is provided beneath the base 35*a* and has a storage volume 35*g*. The lower part 35*f* of the housing is connected via connecting stub 35*h* with the conduit 34 leading to the thermostat valve 36 while the connecting stub 35*i* leads to the crankcase 5.

If an underpressure is present in the crankcase 5, then the opening 35*b* is opened and the air volume is drawn by suction from the bellows 33 via conduit 34. If a definite overpressure is present in crankcase 5, then the membrane 35*c* lies seal-tight against the base 35*a* and closes the opening 35*b* in a leak-tight manner. This dynamic sealing ensures that the valve is opened only during underpressure phases in the crankcase 5. The membrane 35*c* pretensioned in the opening direction further assures that the bellows 33 will be directly ventilated again when the engine is at standstill. The choke flap 15 therefore closes immediately if, during a starting procedure, the engine does not start because of a deficiency in fuel with bellows 33, however, drawn in.

Because of the storage volume 35*g* in the check valve 35, it is assured that the overpressure portion associated with each overpressure phase in the crankcase is compensated for, the overpressure portion penetrating into the conduit system up to closure of the membrane 35*c*.

It can be advantageous to configure the thermostat valve 36 as a continuously regulating valve in lieu of a position control valve. For this purpose, a given flow cross section is continuously changed in dependence upon temperature whereby a good adaptation on the particular operating and ambient temperature is obtained.

FIGS. 9 to 13 show the starting arrangement according to another embodiment of the invention for controlling the throttle flap.

Figure 9:
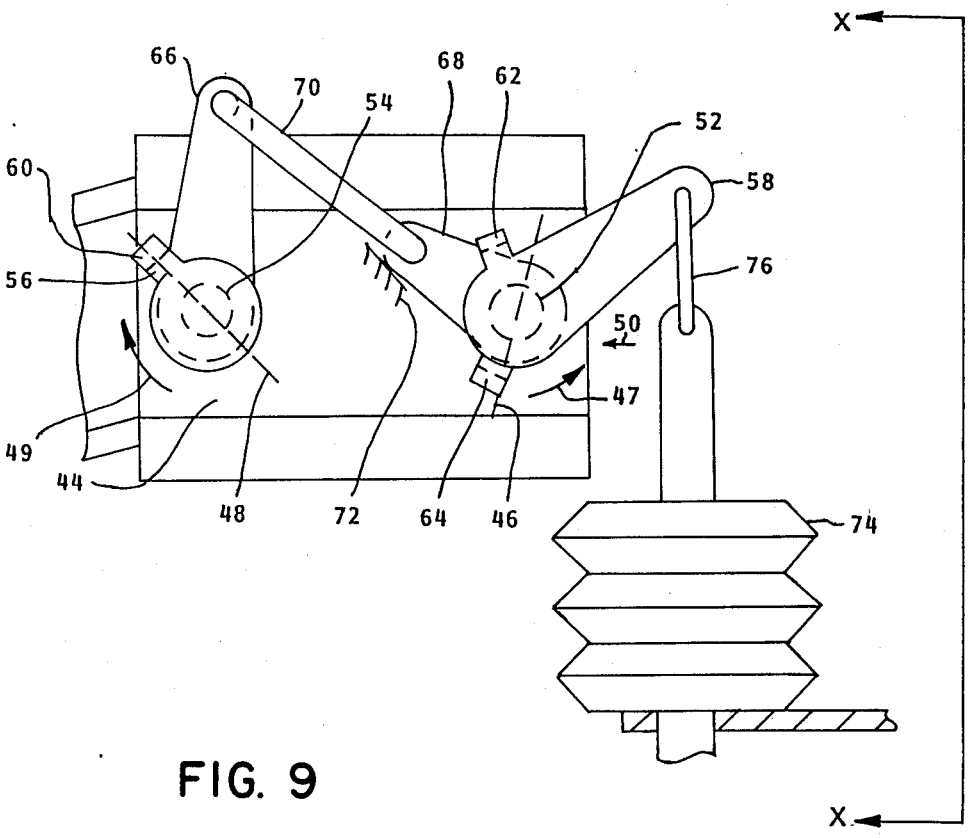
FIG. 9 is a detailed schematic showing a starting arrangement according to another embodiment of the invention.
Figure 10:
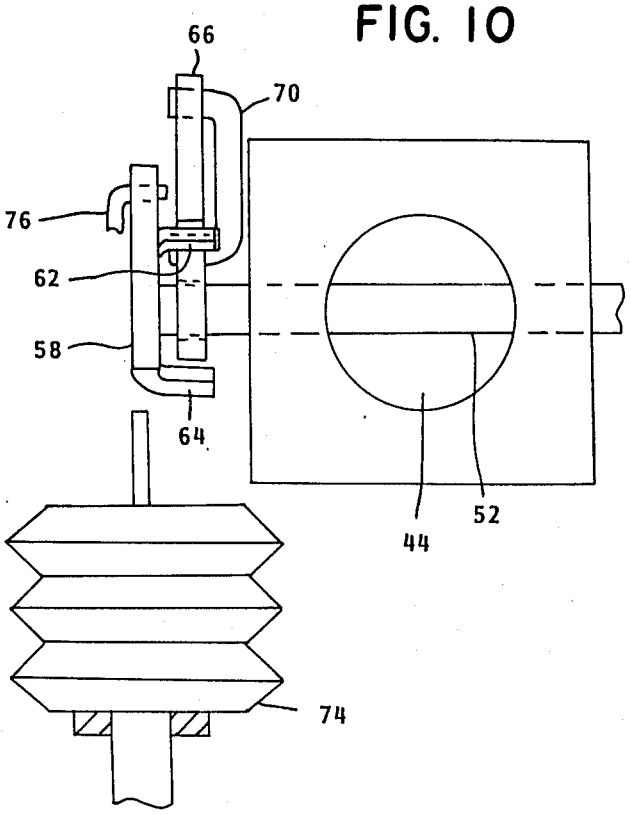
FIG. 10 is an end view of the starting arrangement shown in FIG. 9 viewed at line X—X.

Referring to FIGS. 9 and 10, the air intake channel 44 of the carburetor opens into a cylinder of the engine. A choke flap 46 and a throttle flap 48 are arranged in the air-intake channel 44 one behind the other viewed in the direction of flow 50. The flaps 46 and 48 are fixedly connected with shafts 52 and 54, respectively, for rotation therewith. As seen in FIG. 9, the shafts 52 and 54 lie at an elevation in the air-intake channel corresponding approximately to the central longitudinal axis of the latter. Actuating levers 56 and 58 are fixedly attached to shafts 54 and 52, respectively, for rotation therewith. The lever 56 has a bent-over dog 60 and lever 58 has two bent-over dogs 62 and 64.

Follower levers 66 and 68 are mounted on shafts 54 and 52, respectively, so as to be rotatable with respect thereto. The follower levers 66 and 68 are articulately interconnected by a coupling rod 70. In FIG. 9, the follower lever 68 is shown in abutting engagement with a stop 72.

The actuating lever 58 is connected to bellows 74 via a connecting rod 76. In FIG. 9, the bellows is shown fully ventilated with the engine at standstill. The choke flap 46 is resiliently biased into the position shown by a torsion spring acting in the direction of arrow 47. The throttle flap 48 is resiliently biased in the direction of arrow 49 also by means of a torsion spring. The follower levers 66 and 68 and the actuating levers 56 and 58 together with coupling rod 70 conjointly define a four-lever drive mechanism. For the standstill condition of the engine, the choke flap 46 is in its closed full-choke start position and the throttle flap 48 is held in an intermediate position by means of the four-lever drive mechanism. For the embodiment shown, the intermediate position of the throttle flap 48 is the half-throttle position and corresponds to an opening angle of approximately 30°.

Figure 11:
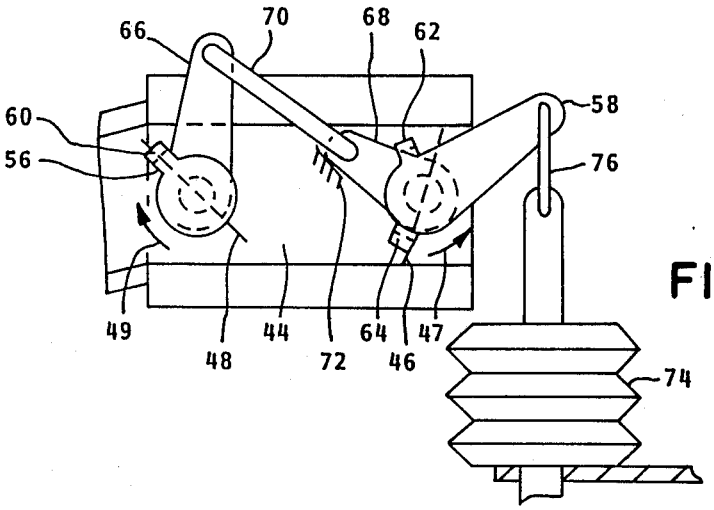
FIG. 11 corresponds to FIG. 9 reduced in scale and shows the throttle flap and choke flap positions for the condition wherein the engine is at standstill.

The four-lever drive mechanism is configured so that the dead-center position thereof is exceeded for the standstill condition shown in FIG. 9. Because of this configuration and the contact engagement of follower lever 68 on stop 72, the four-lever drive mechanism is stable in this position and the two follower levers 66 and 68 with the coupling rod 70 are in a quasi-latched condition. In the position shown in FIG. 9, the two follower levers 66 and 68 and coupling rod 70 coact to hold the throttle flap 48 in the intermediate or half-throttle position against the resilient force of the torsion spring which acts in the direction of arrow 49. The standstill condition of the engine is also shown in FIG. 11 which is the first figure of the starting sequence shown in FIGS. 11 to 13.

Figure 12:
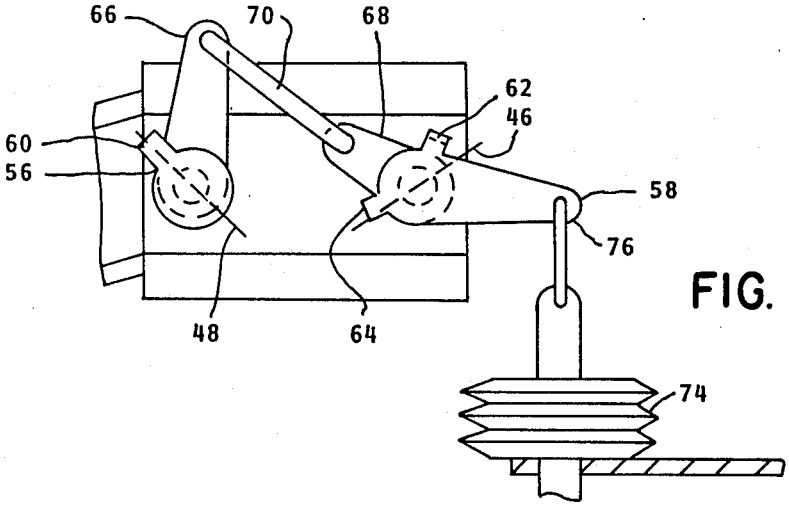
FIG. 12 is the starting arrangement of FIG. 11 showing the positions of the throttle flap and choke flap for the condition wherein the engine is in the starting phase.

FIG. 12 shows the position of the choke flap 46 and the other members of the starting arrangement after the starting operation has been initiated. In FIG. 12, the bellows 74 is shown after having been charged with the underpressure present in the crankcase of the engine. With a sufficiently high underpressure in the bellows 74, the actuating lever 58 is rotated in a clockwise direction. Toward the end of the angular excursion of lever 58, the bent-over dog 64 comes into contact engagement with the follower lever 68 and moves the latter away from stop 72 and through the dead-center position mentioned above thereby effectively unlatching the throttle flap 48. Because of the spring force of the torsion spring acting on the throttle flap 48, the four-lever drive mechanism is moved into the position shown in FIG. 13 by means of the actuating lever 56 which engages the follower lever 66 by means of the bent-over dog 60 and the throttle flap 48 is in the idle position also shown in FIG. 13.

Figure 13:
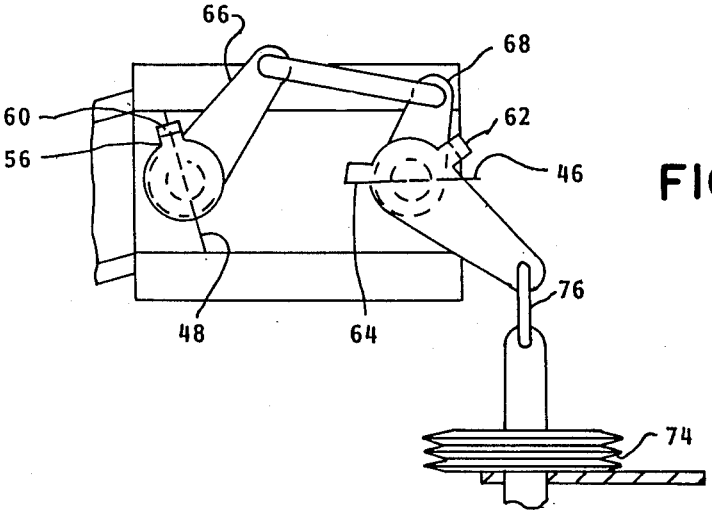
FIG. 13 is the starting arrangement of FIG. 11 showing the respective positions of the choke flap and throttle flap for the condition where the engine is running.

As shown in FIG. 13, the follower lever 66 acts via coupling rod 70 and follower lever 68 on the catch 62 of actuating lever 58. Thus, the catch 62 and therefore the lever 58 are taken along by the follower lever 68 to rotate the choke flap 46 into its no-choke at-rest position shown in FIG. 13.

During operation of the chain saw, the choke flap 46 remains open in the position shown in FIG. 13 and the throttle flap 48 can be freely actuated without any influence on the choke flpp 46 taking place and without any influence on the throttle flap via the choke flap. The throttle flap 48 is freely actuated via a throttle lever and throttle linkage as described earlier with respect to FIGS. 1 and 2.

After the engine is shut off, the bellows is again ventilated and the bellows return to the expanded condition shown in FIG. 11. The spring force acting on the choke flap 46 moves the latter in the closing direction and the throttle flap 48 is again moved into its intermediate position for starting via the actuating lever 58 and the four-lever drive mechanism. As the actuating lever 58 rotates under the force of its torsion spring in the direction of arrow 47, the bent-over catch 62 engages the follower lever 68 and rotates the same past the dead-center position into abutting engagement with stop 72 so that the lever mechanism and throttle flap 48 assume the positions shown in FIG. 11.

This lever system affords the advantage that the throttle flap 48 remains in the fixed predetermined intermediate position shown in FIGS. 11 and 12 during almost the entire time that the choke flap 46 is being opened. In this way, the engine receives more air during the starting operation. This manifests itself positively because the short-term overenrichment of the fuel mixture at the beginning of the choke flap angular displacement is better compensated for. The starting performance of the hot engine is significantly more certain and is improved because less noise is generated by the engine during start-up.

Figure 14:
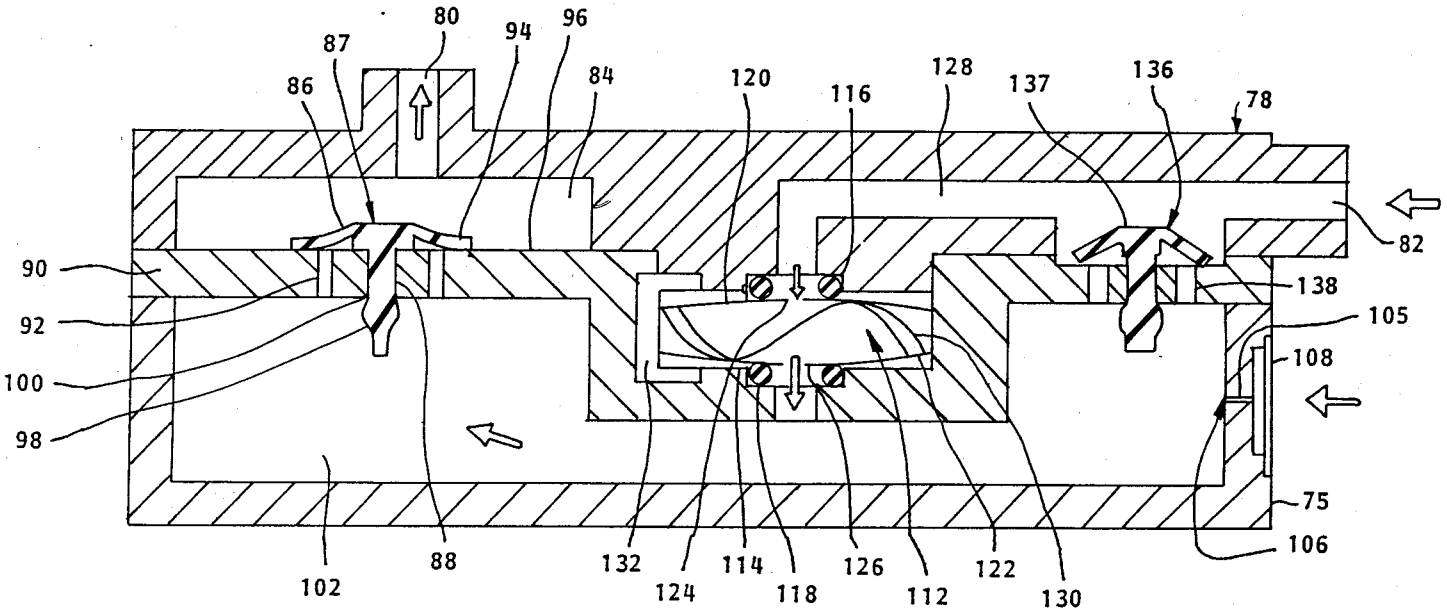
FIG. 14 is a side elevation view, in section, of the bellows valve assembly incorporating a check valve and a throttle valve; and, FIG. 15 is a side elevation view of the throttle valve of the bellows valve assembly of FIG. 14 showing the position of the bimetallic discs after the switching temperature has been reached.

FIG. 14 shows the bellows valve assembly 78 which is connected between the crankcase of the engine and the bellows 74. The bellows valve assembly 78 communicates with the crankcase of the engine via port 80 and with the bellows 74 via port 82. The port 80 leads to a space 84 in housing 75 of the valve assembly 78. A check valve member 86 is disposed in the space 84 and is mounted in a bore 88 of a partition wall 90 of the housing 75. Bores 92 are formed in partition wall 90 and coact with the check valve member 86 which has a mushroom-like configuration. The bores 92 and the check valve member 86 conjointly define the check valve 87. The valve member 86 is made of resilient material and includes an annular flap 94 which is pretensioned in the direction of a sealing surface 96 formed on partition wall 90 so that its outer peripheral edge lies against surface 96. The check valve member 86 is fastened or "buttoned" into a bore 88 of wall 90 with the aid of the protuberance 98 formed at the lower end of the stem 100. During assembly, the valve member 86 is merely inserted into the bore 88 and is seated firmly in place thereby facilitating production of the bellows valve assembly.

A storage chamber 102 is provided in the lower part of the housing 75. The space 84 communicates with storage chamber 102 via bores 92. The storage chamber 102 communicates with the ambient via a bore 105 of a ventilating throttle 106. A screen 108 is mounted in the housing at the outer end of the ventilation throttle 106.

If underpressure is present in the crankcase, then the annular portion 94 of valve member 86 is lifted upwardly away from the sealing surface 96 so that storage chamber 102 can be evacuated and air volume drawn by suction from the bellows 74. During the overpressure phase in the crankcase, the annular portion 85 of the valve 86 seals off the connecting bores 92. The dynamic sealing action ensures that the valve 86 is open only during underpressure phases in the crankcase. The storage chamber 102 assures that the overpressure portion associated with each overpressure phase is compensated for.

For again ventilating the system, the ventilating throttle 106 includes the throttle bore 110. The diameter of the throttle bore 110 is precisely determined with respect to its throttling valve so that on the one hand, the speed of ventilation is sufficiently large and, on the other hand, the mean underpressure in the storage chamber does not become too low.

The arrangement of the check valve 87 and ventilating throttle 106 affords the advantage that the collection of liquid in the storage chamber 102 is prevented. This liquid would otherwise collect in chamber 102 because of a leakage flow from the crankcase during the switching operation of the dynamically operating check valve 87. In addition, the underpressures obtainable at predetermined rotational speeds are higher from which a greater functional certainty for the entire system is derived. A third advantage is seen in that the bellows valve assembly of FIG. 10 is very much less sensitive with respect to manufacturing tolerances so that the requirements for manufacturing precision are significantly less.

The bellows valve assembly 78 also includes a suction throttle 112 mounted in a cavity 114 of the housing 75. The suction throttle 112 includes two annular seals 116 and 118 which coact with respective bimetal discs 120 and 122. The bimetal discs 120 and 122 have respective throttling apertures 124 and 126. The suction throttle 112 is a thermostat valve responsive to the temperature of the engine which changes the flow-through cross section of the passage interconnecting the channel 128 to the storage chamber 102 in dependence upon the temperature. The two bimetal discs 120 and 122 are arranged in this passage and are braced against respective seals 116 and 118 by means of a spring 130. So long as the temperature of the engine is beneath the switching temperature, the bimetal discs 120 and 122 will stay in seal-tight engagement with the respective seals 116 and 118 so that air can be drawn from the bellows 74 only through the respective apertures 124 and 126. Thus, beneath the switching temperature, a very intense throttling via the apertures 124 and 126 is provided and a sufficiently slow draw-in speed of the bellows 74 is achieved.

Figure 15:
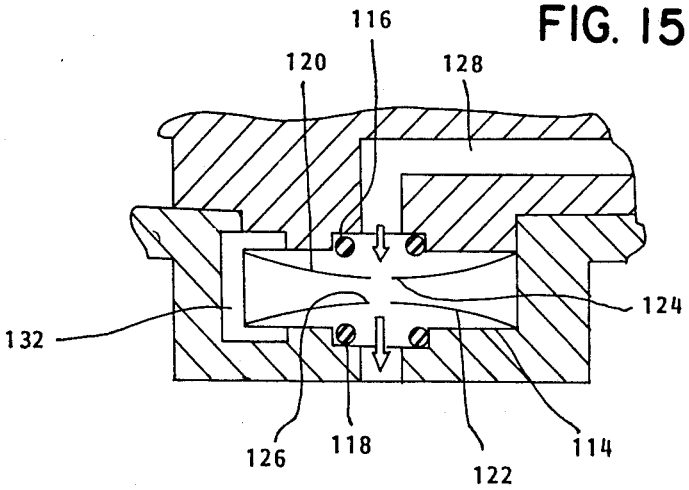

As soon as the switching temperature is reached, the bimetal discs snap back away from the sealing rings 116 and 118 thereby providing a widened flow path from the channel 128 to storage chamber 102. The bimetal discs 120 and 122 then assume the respective positions shown in FIG. 15 and the air passes around the bimetal discs via a bypass defined by the expanded cavity portion 132. The spring 130 has been omitted from FIG. 15 for clarity. Thus, no suction throttling is provided when the temperature of the engine has exceeded the switching temperature of the bimetal discs so that with the start procedure of a warm engine, the choke flap 46 is rapidly opened in order to prevent a too intense overenrichment of the fuel mixture.

The bellows valve assembly 78 also includes a ventilating valve 136 which significantly improves the ventilating performance of the bellows 74, that is, the speed with which the bellows can be ventilated at low temperatures. The ventilating valve 136 has a mushroom-type valve member 137 and bores 138. The ventilating valve 136 functions in the same manner as check valve 86. In the presence of an underpressure, the valve member 137 tightly seals off the bores 138 interconnecting port 82 and storage chamber 102.

However, when the engine has been shut off and it is necessary to ventilate the bellows 74, the latter is quickly ventilated with air passing through bores 138.

Without the ventilating valve 136, the bellows 74 would only be ventilated through the suction apertures 124 and 126 in the respective bimetal discs 120 and 122 for the condition wherein the engine temperature is above the switching temperature. Since the apertures 124 and 126 are very much smaller than the bore 110 connecting the storage chamber 102 with the ambient, a bypass of the suction throttle 112 achieves a higher speed of ventilation of the bellows for the condition wherein the engine is hot and the bimetal discs are in the position shown in FIG. 14.

It is understood that the foregoing description is that of the preferred embodiments of the invention and that various changes and modifications may be made thereto without departing from the spirit and scope of the invention as defined in the appended claims.

What is claimed is:

1. An automatic starting arrangement for an internal combustion engine such as the manually startable engine of a handheld portable tool equipped with a carburetor defining an intake channel through which air flows to the engine, the engine having a crankcase wherein underpressure develops during the operation thereof, the arrangement comprising:

a choke flap movably mounted in the intake channel so as to be movable from a full-choke start position to an intermediate partial-choke position corresponding to a partial choke condition and then to a no-choke at-rest position;

first resilient biasing means for resiliently biasing said choke flap into said start position;

a throttle flap mounted in the intake channel so as to be movable from a first position corresponding to the idle running condition of the engine to an intermediate second position corresponding to a partial-throttle condition and then to a third position corresponding to the full-throttle running condition of the engine;

manually operable throttle lever means connected to said throttle flap for actuating the same;

second resilient biasing means for resiliently biasing said throttle flap toward said first position;

said flaps being mounted one behind the other when viewed in the direction of air flow to the engine;

movable holding means for holding said throttle flap in said second position against the force of said second resilient biasing means when said choke flap is in said start position and during its movement from said start position to said intermediate partial-choke position;

actuating means for moving said choke flap from said start position into said at-rest no-choke position in response to said underpressure and, unlatching means for coacting with said holding means to unlatch said throttle flap when said choke flap enters said intermediate partial-choke position.

2. The automatic starting arrangement of claim 1, comprising latching means for engaging and moving said holding means to return and hold said throttle flap in said intermediate partial choke position.

3. The automatic starting arrangement of claim 1, the starting arrangement further comprising:

an actuating lever fixedly connected to said choke flap for rotational movement therewith; and, a bellows for actuating said actuating lever from said full-choke start position into said no-choke at-rest position in response to said underpressure; and, said unlatching means being a catch formed on said actuating lever for engaging and moving said holding means to unlatch said throttle flap as said choke flap passes through said intermediate partial choke position.

4. The automatic starting arrangement of claim 3, said actuating lever being a first actuating lever and said starting arrangement comprising a second actuating lever fixedly connected to said throttle flap for rotation therewith and for engaging said holding means to impart a further movement to the latter; and, said first actuating lever having a second catch formed thereon for receiving said holding means so as to be taken along thereby to rotate said choke flap into said no-choke at-rest position.

5. The automatic starting arrangement of claim 3, said actuating means comprising a valve assembly interposed between said bellows and the crankcase.

6. The automatic starting arrangement of claim 5, said valve assembly comprising: a housing defining a first port communicating with the crankcase of the engine and a second port communicating with said bellows; a check valve mounted in said housing between said ports and being pretensioned in the closed position, said check valve being configured so as to open in response to an underpressure condition in said crankcase.

7. The automatic starting arrangement of claim 6, said housing being configured to have a storage volume for compensating for overpressure phases occurring in the crankcase.

8. The automatic starting arrangement of claim 6, said valve assembly further comprising a thermostat valve disposed between said check valve and said bellows, said thermostat valve being configured so as to change the pass-through cross section between said check valve and said bellows in dependence upon a predetermined temperature of the engine.

9. The automatic starting arrangement of claim 8, said valve assembly being mounted on a cylinder of the engine.

10. The automatic starting arrangement of claim 9, said valve assembly being mounted between cooling ribs of the engine.

11. The automatic starting arrangement of claim 8, said thermostat valve comprising:

a chamber formed in said housing and having an inlet passage communicating with said bellows and an outlet passage communicating with said check valve;

bimetal means having aperture means formed therein defining a first pass-through opening for conducting air from said inlet passage to said outlet passage;

a bypass formed in said chamber interconnecting said inlet passage and said outlet passage;

said bimetal means being dimensioned to move in response to a predetermined temperature of the engine between a first position whereat only said aperture means is disposed between said inlet and outlet passages to permit a first quantity air to pass to said check valve and a second position to permit said bypass to interconnect said inlet and outlet passages; and, said bypass having a cross section much greater than the cross section of said aperture means whereby a second quantity of air much greater than said first quantity can pass to said check valve.

12. The automatic starting arrangement of claim 8, the valve assembly further comprising ventilating valve means for rapidly ventilating said bellows when the engine is at a temperature above said predetermined temperature.

13. The automatic starting arrangement of claim 12, the valve assembly further comprising ventilating throttle means interconnecting said thermostat valve and said ventilating valve means with the ambient.

14. The automatic starting arrangement of claim 3, said bellows including: a connecting member connected to said actuating lever for actuating the latter, said connecting member being arranged to move through a predetermined stroke distance; and, valve means for controlling the speed at which said connecting member is moved through said distance, said valve means including means for changing the cross section through which air is drawn from said bellows after said connecting member has moved through a predetermined portion of said stroke distance.

15. The automatic starting arrangement of claim 14, said bellows including a base; and, said last-mentioned means including a suction opening formed in said base and a valve body operatively connected to said connecting member for closing said suction opening toward the end of the movement through said stroke distance; said last-mentioned means further including a bypass bypassing said suction opening.

16. The automatic starting arrangement of claim 1, the handheld portable tool being a chain saw having a throttle lever operatively connected to said throttle flap, the arrangement comprising detent means for blocking said throttle lever in a predetermined position wherein said throttle flap and said choke flap are held in respective open positions.

* * * * *